US011643806B2

(12) United States Patent
Berger et al.

(10) Patent No.: US 11,643,806 B2
(45) Date of Patent: May 9, 2023

(54) BUILDING BLOCKS CONTAINING PLANT FIBERS, CONSTRUCTION SYSTEM USING SAME, AND METHOD OF CONSTRUCTION USING SAME

(71) Applicants: Eric Berger, Richmond, VA (US); Regan Berger, Richmond, VA (US)

(72) Inventors: Eric Berger, Richmond, VA (US); Regan Berger, Richmond, VA (US)

( * ) Notice: Subject to any disclaimer, the term of this patent is extended or adjusted under 35 U.S.C. 154(b) by 0 days.

(21) Appl. No.: 17/373,753

(22) Filed: Jul. 12, 2021

(65) Prior Publication Data

US 2022/0018115 A1 Jan. 20, 2022

Related U.S. Application Data

(60) Provisional application No. 63/053,371, filed on Jul. 17, 2020.

(51) Int. Cl.

| | |
|---|---|
| ***E04B 1/35*** | (2006.01) |
| ***E04C 1/39*** | (2006.01) |
| ***E04B 2/14*** | (2006.01) |
| ***E04C 1/40*** | (2006.01) |

(52) U.S. Cl.

CPC ..... *E04B 1/3555* (2013.01); *E04B 2/14* (2013.01); *E04C 1/39* (2013.01); *E04C 1/40* (2013.01)

(58) Field of Classification Search

CPC . E04B 1/3555; E04B 2/14; E04C 1/39; E04C 1/40

USPC ..... 52/606, 607, DIG. 9

See application file for complete search history.

(56) References Cited

U.S. PATENT DOCUMENTS

| | | | | | |
|---|---|---|---|---|---|
| 2,392,552 | A * | 1/1946 | Roe | E04C 1/40 | 52/309.1 |
| 3,180,059 | A * | 4/1965 | Persak, Jr. | E04B 2/18 | 52/503 |
| 3,440,788 | A * | 4/1969 | Merget | E04C 1/40 | 52/576 |
| 3,545,155 | A * | 12/1970 | Church, Jr. | E04C 1/40 | 52/741.11 |
| 3,685,244 | A * | 8/1972 | Palmer | E04C 1/40 | 52/DIG. 9 |
| 4,258,522 | A * | 3/1981 | Amaral | E04C 1/40 | 52/309.1 |
| 5,186,883 | A | 2/1993 | Beall | | |

(Continued)

FOREIGN PATENT DOCUMENTS

| | | |
|---|---|---|
| CA | 2229589 A1 | 10/1999 |
| CN | 103334533 B | 1/2016 |

(Continued)

OTHER PUBLICATIONS

International Search Report and Written Opinion for PCT Appl. No. PCT/US2021/041374, dated Mar. 28, 2022, 20 pages.

*Primary Examiner* — Brian E Glessner
*Assistant Examiner* — Adam G Barlow
(74) *Attorney, Agent, or Firm* — Thedford I. Hitaffer; Hitaffer & Hitaffer, PLLC

(57) ABSTRACT

A building block comprises a rigid housing defining a chamber and plant fibers contained within the chamber. A construction system comprises a plurality of such building blocks, selectively stackable to form a wall. A method of construction comprises obtaining a plurality of such building blocks, inserting plant fibers into the chamber, and stacking the plurality of building blocks to form one or more walls.

47 Claims, 19 Drawing Sheets

(56) References Cited

U.S. PATENT DOCUMENTS

| | | | | | |
|---|---|---|---|---|---|
| 5,507,127 | A * | 4/1996 | Gates | E04C 1/40 | 52/DIG. 9 |
| 5,749,199 | A * | 5/1998 | Allen | E04C 3/28 | 52/DIG. 9 |
| 5,937,588 | A * | 8/1999 | Gard | E04B 1/3555 | 52/DIG. 9 |
| 6,041,566 | A | 3/2000 | Allen | | |
| 7,631,466 | B2 | 12/2009 | Black | | |
| 8,414,816 | B2 | 4/2013 | Korman et al. | | |
| 8,448,410 | B2 | 5/2013 | Korman et al. | | |
| 8,910,438 | B1 * | 12/2014 | Shiban | E04H 9/14 | 52/DIG. 9 |
| 10,458,116 | B2 | 10/2019 | Krupskij et al. | | |
| 11,173,413 | B2 * | 11/2021 | Ishimatsu | A63H 33/086 | |
| 11,352,785 | B2 * | 6/2022 | Simmons, Jr. | E04C 1/00 | |
| 11,441,309 | B1 * | 9/2022 | Asiala, Jr. | E04C 1/39 | |
| 2004/0040245 | A1 | 3/2004 | Sinclair et al. | | |
| 2009/0077920 | A1 * | 3/2009 | Korman | B29C 43/06 | 249/176 |
| 2010/0170187 | A1 | 7/2010 | Korman et al. | | |
| 2011/0086189 | A1 * | 4/2011 | Bigger | E04C 1/395 | 428/33 |

FOREIGN PATENT DOCUMENTS

| | | | | |
|---|---|---|---|---|
| DE | 4217769 | C1 | 7/1993 | |
| EP | 2543788 | B1 | 9/2016 | |
| GB | 369241 | | 3/1932 | |
| GB | 369241 | A * | 3/1932 | |
| GB | 1202092 | | 8/1970 | |
| WO | 2005053441 | A2 | 6/2005 | |
| WO | WO-2005053441 | A2 * | 6/2005 | A24B 1/10 |
| WO | 2012033371 | A2 | 3/2012 | |
| WO | 2019215368 | A1 | 11/2019 | |

* cited by examiner

BUILDING BLOCKS CONTAINING PLANT FIBERS, CONSTRUCTION SYSTEM USING SAME, AND METHOD OF CONSTRUCTION USING SAME

CROSS-REFERENCE TO RELATED APPLICATIONS

This application claims priority to U.S. Provisional Application Ser. No. 63/053,371, filed Jul. 17, 2020, the contents of which are incorporated herein by reference in its entirety.

FIELD OF THE INVENTION

The present technology relates generally to building materials.

BACKGROUND

It is known to compress natural fibrous materials into bales having a generally rectangular prism shape. Such bales may be stacked to construct residential and commercial recreational structures. Such conventional bales are inexpensive to construct, and they typically use waste material and provide good insulation. However, the use of conventional bales for construction has many disadvantages. These disadvantages may include higher labor intensity and cost, greater risk of fire at the construction site, inspection and permitting challenges, pest infestation (especially during the building phase), thicker walls than are typically preferred, thermal breakpoints due to gaps between bales, decay due to penetration of moisture and humidity, limitations on hanging elements such as shelves and cabinets due to lack of studs, limitations on the materials that can be used to coat the bales, and the tendency of plaster (which is generally used to coat the bales) to degrade, leading to water and pest penetration.

BRIEF SUMMARY OF THE DISCLOSURE

In one embodiment of the invention, a building block comprises a rigid housing defining a chamber and plant fibers contained within the chamber.

The plant fibers may comprise one or more of the straw of cereal crops (including but not limited to wheat, rice, oats, rye, and barley straw), hemp fiber, corn stover or straw, bamboo fiber, Johnson grass, thatch grass, and other forms of plant straw, fiber, reeds, grasses, and weeds.

The housing may comprise six walls forming a generally rectangular prism shape.

The housing may comprise a lid that is selectively sealable to seal the plant fibers within the chamber.

The housing may comprise at least a first wall having one or more projections adapted to interlock with one or more corresponding indentations on one or more adjacent building blocks. The housing may comprise at least a second wall, opposite the first wall, having one or more indentations adapted to interlock with one or more corresponding projections on one or more adjacent building blocks.

The building block may further comprise a vacuum fitting secured to the housing and adapted to enable air to be drawn out of the chamber.

The plant fibers may be contained within one or more vacuum-sealed bags.

The housing may comprise at least a top wall and an opposing bottom wall. A through-hole may extend from the top wall to the bottom wall, such that the through-hole is adapted to align with a corresponding through-hole in an adjacent building block and to receive a reinforcing rod. The through-hole may be defined by a cylinder extending from the top wall to the opposing bottom wall.

The housing may comprise at least a first wall and an opposing second wall, and the building block may further comprise a first conduit extending from the first wall to the second wall adapted to receive electrical and/or plumbing lines. The housing may further comprise at least a third wall and an opposing fourth wall, and the building block may further comprise a second conduit extending from the third wall to the fourth wall adapted to receive electrical and/or plumbing lines. The housing may further comprise at least a fifth wall and an opposing sixth wall, and the building block may further comprise a third conduit extending from the fifth wall to the sixth wall adapted to receive electrical and/or plumbing lines. The first, second, and third conduits may intersect such that continuous pathways are defined among the first, second, and third conduits.

The housing may further comprise at least a first wall, and the building block may further comprise a first slot defined on the first wall and adapted to abut a corresponding first slot defined on a wall of an adjacent building block to together define a first conduit between the building block and the adjacent building block. The building block may further comprise a second slot defined on the first wall, with the second slot being perpendicular to and intersecting the first slot. The second slot is adapted to abut a corresponding second slot defined on a same wall of an adjacent building block as the first slot to together define a second conduit between the building block and the adjacent building block.

In alternative embodiments of the invention, a construction system comprises a plurality of building blocks as defined herein, with the plurality of building blocks being selectively stackable to form a wall.

In alternative embodiments of the invention, a method of construction comprises obtaining a plurality of building blocks as described herein, inserting plant fibers into the chamber, and stacking the plurality of building blocks to form one or more walls.

The housing of one or more of the plurality of building blocks may comprise a lid that is selectively sealable to seal the plant fibers within the chamber, and the method may further comprise sealing the lid after inserting the plant fibers into the chamber.

One or more of the plurality of building blocks may further comprise a vacuum fitting secured to the housing and adapted to enable air to be drawn out of the chamber, and the method may further comprise applying a vacuum device to the vacuum fitting to draw air out of the chamber.

The method may further comprise inserting plant fibers into one or more bags and vacuum-sealing the one or more bags, and inserting the one or more vacuum-sealed bags into the chamber of one or more of the plurality of building blocks.

One or more of the plurality of building blocks may comprise a through-hole extending from a top wall to a bottom wall of the one or more of the plurality of building blocks, such that the through-hole is adapted to align with a corresponding through-hole in an adjacent building block and to receive a reinforcing rod. The method may further comprise inserting a reinforcing rod through the through-holes of two adjacent building blocks.

One or more of the plurality of building blocks may further comprise a first conduit extending from a first wall to a second wall to receive electrical and/or plumbing lines, and the method may further comprise inserting one or more electrical lines and/or one or more plumbing lines through the first conduit. One or more of the plurality of building blocks may further comprise a second conduit extending from a third wall to a fourth wall to receive electrical and/or plumbing lines, and the method may further comprise inserting one or more electrical lines and/or one or more plumbing lines through the second conduit. One or more of the plurality of building blocks may further comprise a third conduit extending from a fifth wall to a sixth wall to receive electrical and/or plumbing lines, and the method may further comprise inserting one or more electrical lines and/or one or more plumbing lines through the third conduit.

BRIEF DESCRIPTION OF THE SEVERAL VIEWS OF THE DRAWINGS

Reference will now be made to the accompanying drawings, which are not necessarily drawn to scale. The following detailed description of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
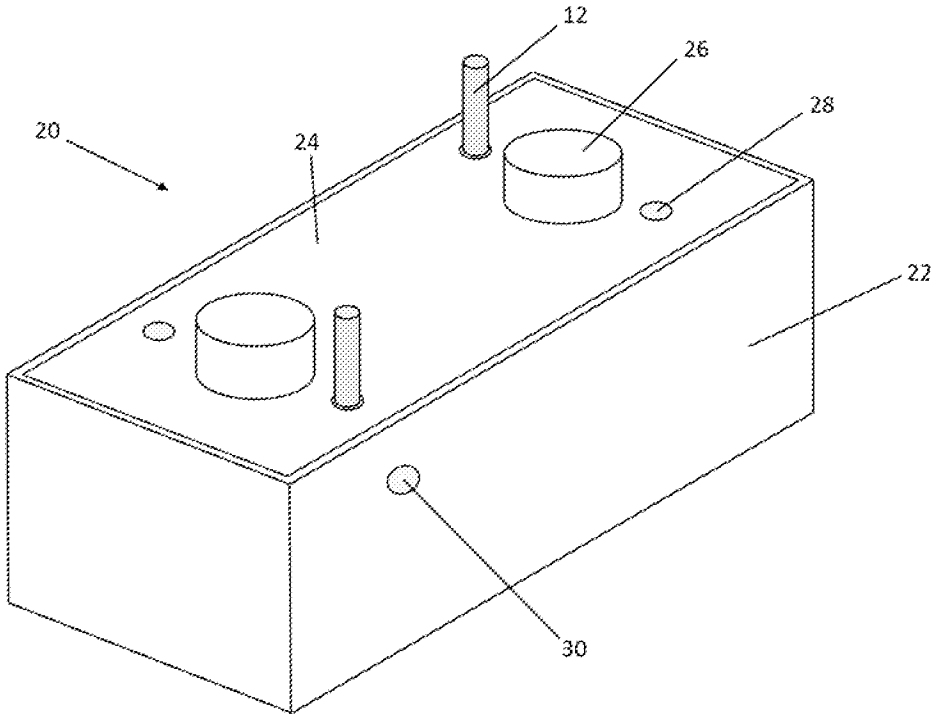
FIG. 1 is a perspective view of a building block, in accordance with embodiments of the invention.

Certain terminology is used in the following description for convenience only and is not limiting. The words "lower," "bottom," "upper," "top," "left" and "right" and the like designate directions in the drawings to which reference is made. The words "inwardly," "outwardly," "upwardly" and "downwardly" and the like refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to a building or construction system comprising pre-formed, fully-enclosed containers of various sizes that are filled with plant fibers and stacked in various combinations to form durable, load-bearing (both vertical and horizontal), insulating, and moisture-, pest-, and flame-resistant elements of residential, commercial, and recreational structures (when filled and fully enclosed the components may be termed "blocks"). The plant fibers may comprise any fibrous vegetative product, including but not limited to the straw of cereal crops (including but not limited to wheat, rice, oats, rye, and barley straw), hemp fiber, corn stover or straw, bamboo fiber, Johnson grass, thatch grass, and other forms of plant straw, fiber, reeds, grasses, and weeds. The plant fibers may be of any suitable length or range of lengths, and may be cut, shredded, or otherwise processed to obtain the desired length(s). The plant fibers may be sealed within vacuum-sealed bags which are in turn placed into the containers. The containers into which the plant fibers are placed, and therefore the completed building blocks, may include integrated channels or conduits through which to run plumbing lines, electrical lines, etc.

The blocks are sealed to protect against moisture, insect, and light entry, making the system stronger, more durable, and less problematic than conventional bales. The blocks are preferably joined with an integral interlocking mechanism, and may include one or more integrated channels that serve as conduits for electrical wiring, plumbing, and other purposes. The system may comprise pre-formed, fully enclosed filler blocks that cap any channel not required as a conduit. The channels may be of any suitable shape (e.g., rectangular prism (as illustrated), cylindrical, etc.), and any suitable size.

The blocks typically have a generally rectangular prism shape. The blocks typically come in full length and half length. The blocks typically have one or more upwardly projecting protrusions on the top side that engage and may form a locking connection with corresponding depressions in the bottom side of one or more adjacent blocks (the full length blocks typically have two projections and two depressions, while the half length blocks typically have one projection and one depression). The blocks may have a vertical channel defined at about the middle of the block. The blocks may have a horizontal channel or conduit perpendicular to the longitudinal axis defined at about the middle of the block. The blocks may have a horizontal channel or conduit parallel to the longitudinal axis of the block. The blocks may have a horizontal channel or slot and/or a vertical channel or slot defined in one or both end faces. The end face channels are typically about half the width of the mid-block channels, since the end face channels typically join with end face channels of an adjoining block, thereby together forming a conduit having about the same size as the mid-block channels.

The containers are initially (at least partially) hollow and define an internal chamber for receiving the plant fibers within. The containers are preferably constructed of an ecologically sensitive material (e.g., fiberglass manufactured using recycled glass), but any suitable material may be used that is sufficiently strong, rigid, and durable (such as any suitable plastic). The containers are pre-cast, molded, or otherwise constructed of two primary components: (1) a base box of various sizes (including length, width, depth, height, and thickness) having an open side (e.g., top) and (2) a lid that is fitted to the open side of the base after the base is filled with plant fibers. Typically, the lid fits relatively snugly within the open side and sits on a shelf or shoulder formed within the chamber near the open side, such that the lid is flush with the edges of the base box surrounding the open side. The base box and the lid may or may not include pre-formed channels. (Alternatively, the edges surrounding the open side may be narrowed to fit within a perimeter edge of the lid, however any suitable base/lid structure or configuration may be used.)

The containers will typically include integrated supports to aid in load bearing. These supports will typically take the form of the walls of the integrated channels (for those containers equipped with them) and/or internal supports for those containers not equipped with integrated channels.

The base box is filled with plant fibers. The plant fibers are poured into the base box and optionally compressed by manual or mechanical means such as tamping, vacuum sealing, or other suitable process to ensure a complete fill with negligible settling. The value of compression is to reduce or eliminate air, thereby improving moisture, fire, and pest resistance while also improving the load-bearing nature of the containers. Optionally, the plant fibers may be sealed within vacuum-sealed bags which are in turn placed into the containers. The lid is then fitted to the base box to form a fully enclosed container that is moisture, insect, and light-proof. The lid is preferably sealed in place on the base box, such as by applying a suitable adhesive to the shelf or shoulder after the plant fibers are compressed but before the lid is fitted in place on the shelf or shoulder. Other suitable means or mechanisms may be used to seal the lid to the base box, depending on the material(s) used to construct the container.

The containers into which the plant fibers are sealed, and therefore the completed blocks, may have any suitable size, shape, number, size, and arrangement of channels and protrusions/depressions. In one exemplary embodiment of the invention, the full length blocks are about 24 inches long, about 8 inches tall, and about 8 inches wide, the half length blocks are about 12 inches long, about 8 inches tall, and about 8 inches wide, and the filler blocks are about 4 inches long, about 4 inches tall, and about 4 inches wide (but again any suitable size filler blocks may be used to fit the applicable shape (e.g., rectangular prism, cylindrical, etc.) and size of the integrated channel). In the illustrated embodiment, the full length blocks have two cylindrical protrusions on the top surface and two corresponding cylindrical depressions on the bottom surface, while the half length blocks have one cylindrical protrusion on the top surface (and would therefore have one corresponding cylindrical depression on the bottom surface that is not illustrated).

Figure 2:
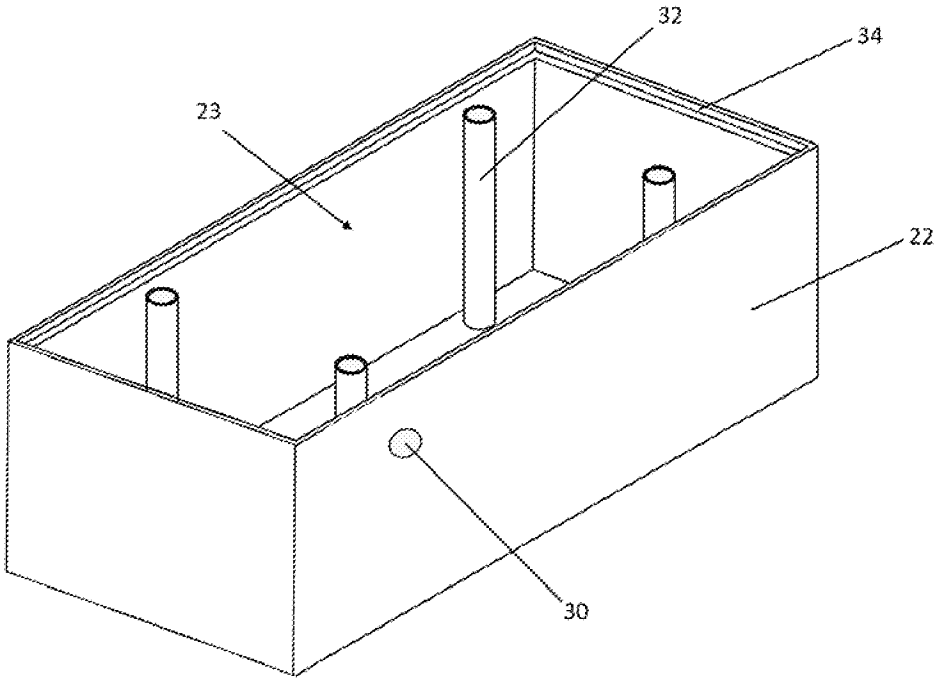
FIG. 2 is a perspective view of the building block of FIG. 1, with its lid removed.
Figure 3:
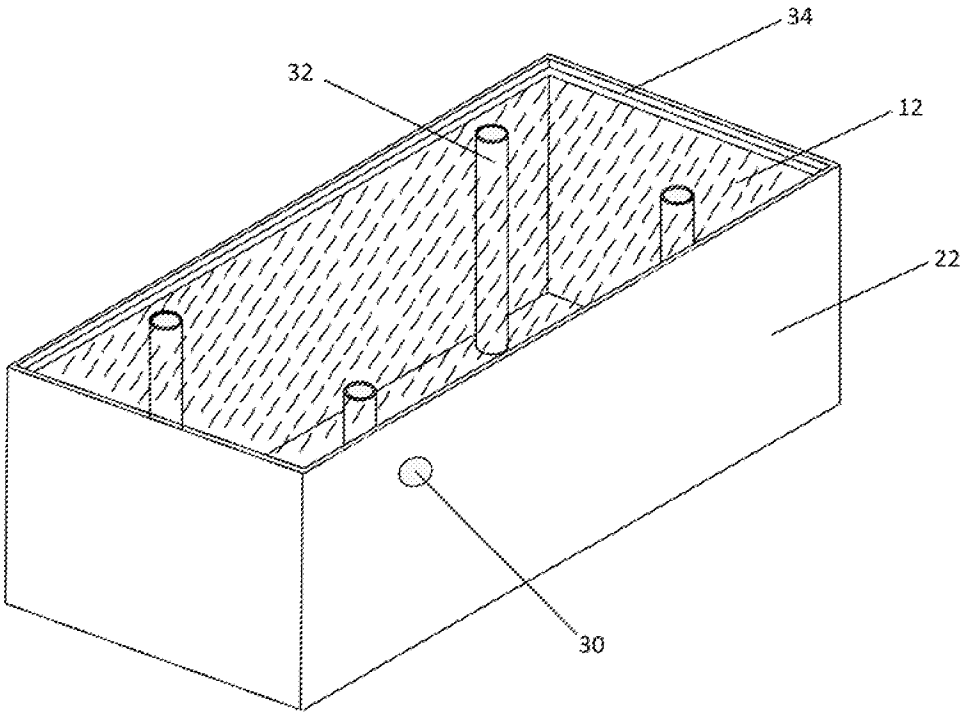
FIG. 3 is a perspective view of the building block of FIG. 1, with its lid removed and filled with plant fibers.
Figure 4:
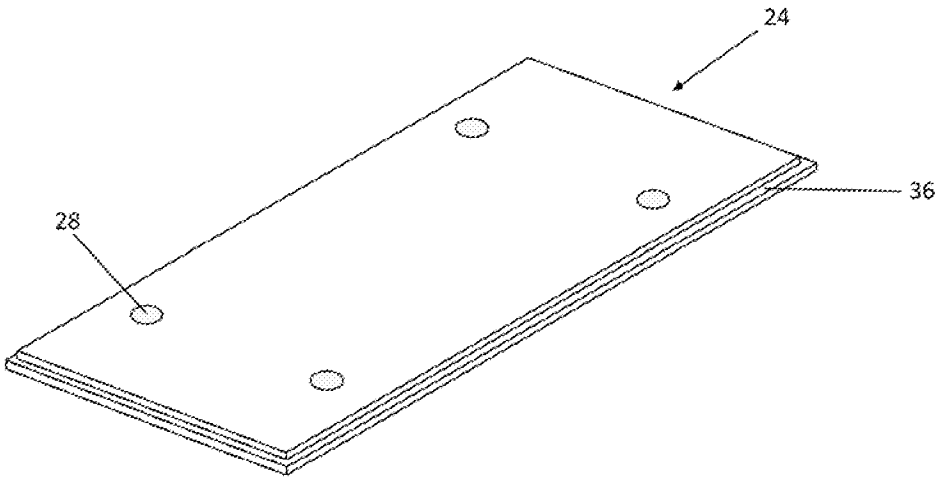
FIG. 4 is a perspective view of the underside of the lid of the building block of FIG. 1.

FIGS. 1-5 illustrate a building block, in accordance with embodiments of the invention. The building block 20 of FIGS. 1-5 comprises a housing 22 defining a chamber 23 into which plant fibers (e.g., straw) 12 may be placed. In the illustrated embodiment, the building block 20 comprises six walls forming a generally rectangular prism shape (as described above, other shapes may be used). A lid 24 is selectively removable (before it is sealed into place) to enable the fibers to be placed in the chamber 23 and is selectively sealable to seal the fibers within the chamber 23. As seen in FIG. 2, the housing 22 has a shoulder 34 around the top edge such that the lid 24 sits down into the opening and on the shoulder 34. As seen in FIG. 4, the lid 24 also has a shoulder 36 to provide another sealing surface to which adhesive may be applied to ensure that the lid 24 is securely retained to the housing 22.

Figure 5:
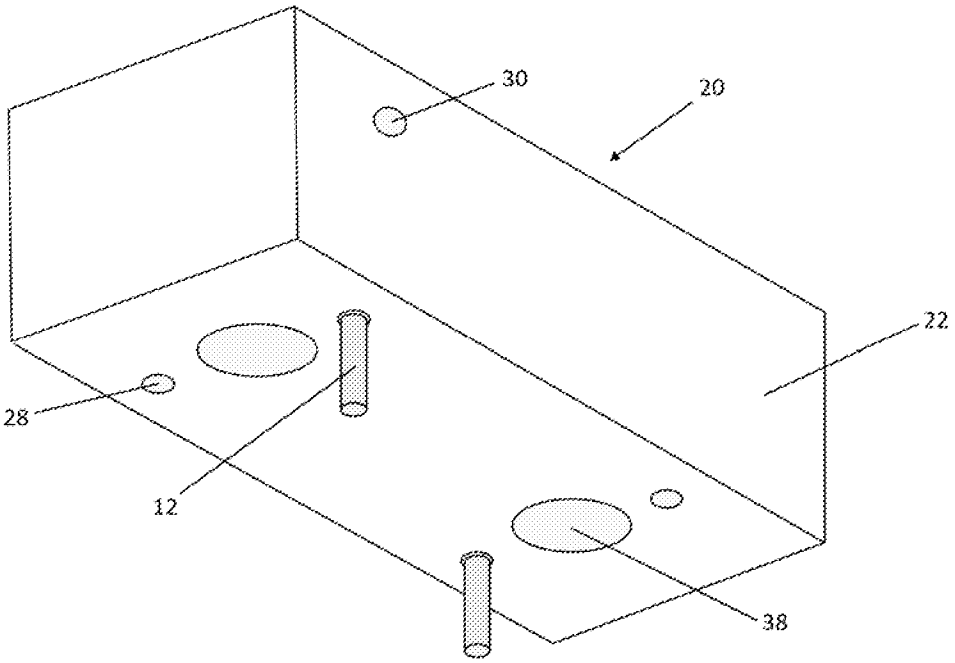
FIG. 5 is a perspective view from the bottom of the building block of FIG. 1.
Figure 6:
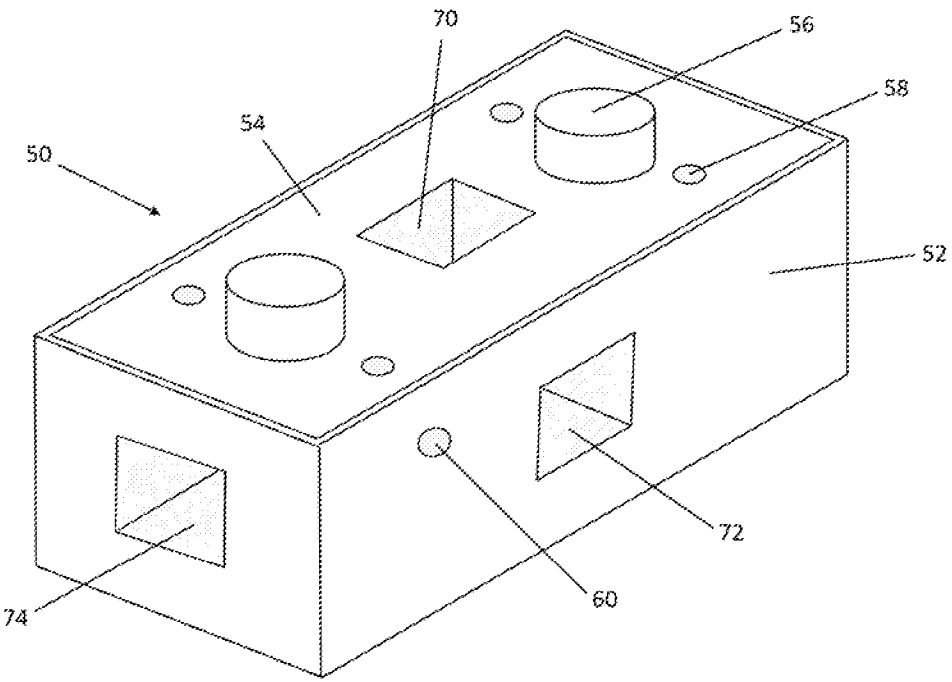
FIG. 6 is a perspective view of a building block, in accordance with alternative embodiments of the invention.
Figure 14:
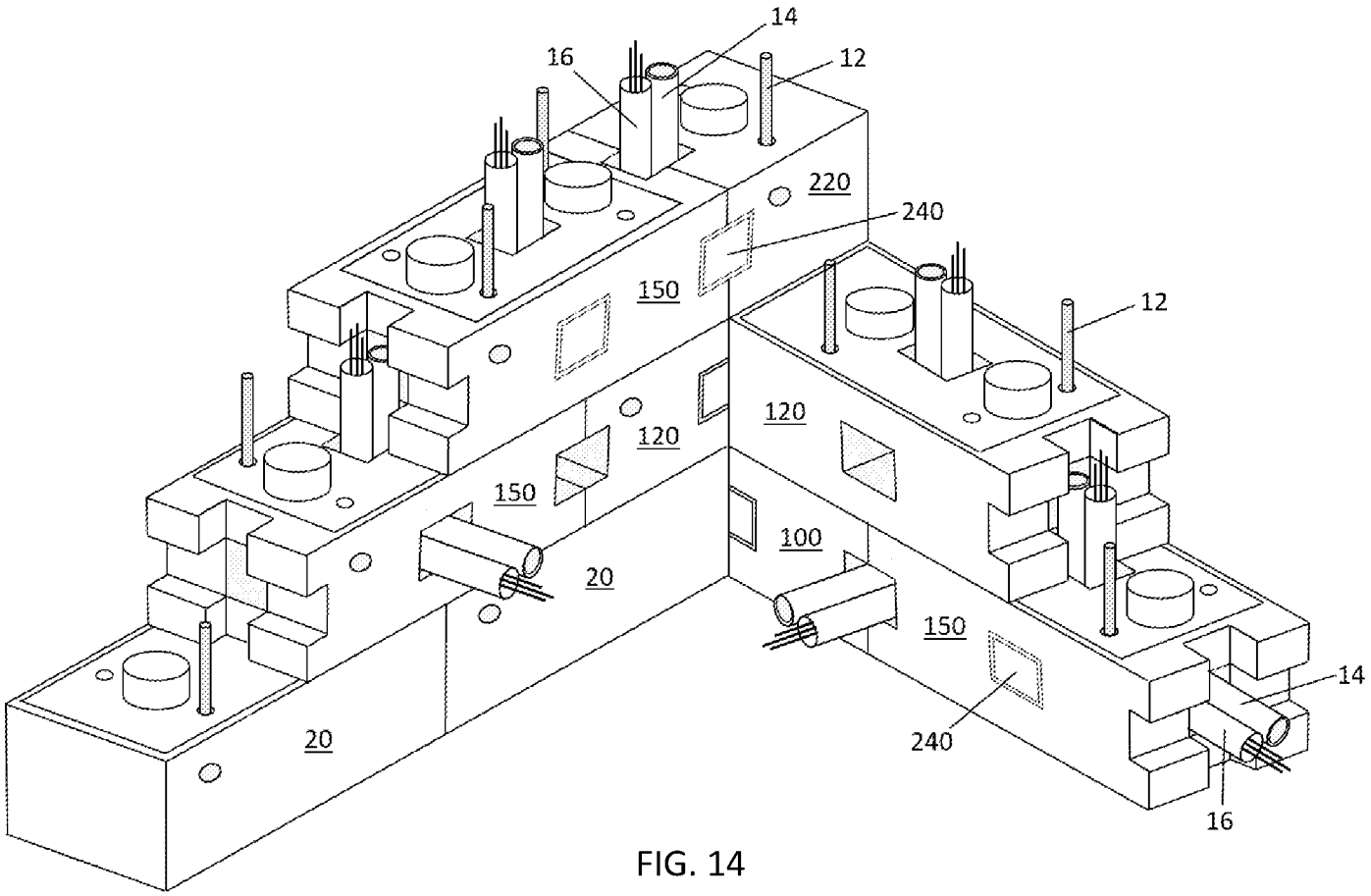
FIG. 14 is a perspective view of portions of two walls meeting at a corner built using building blocks of embodiments of the invention.
Figure 15:
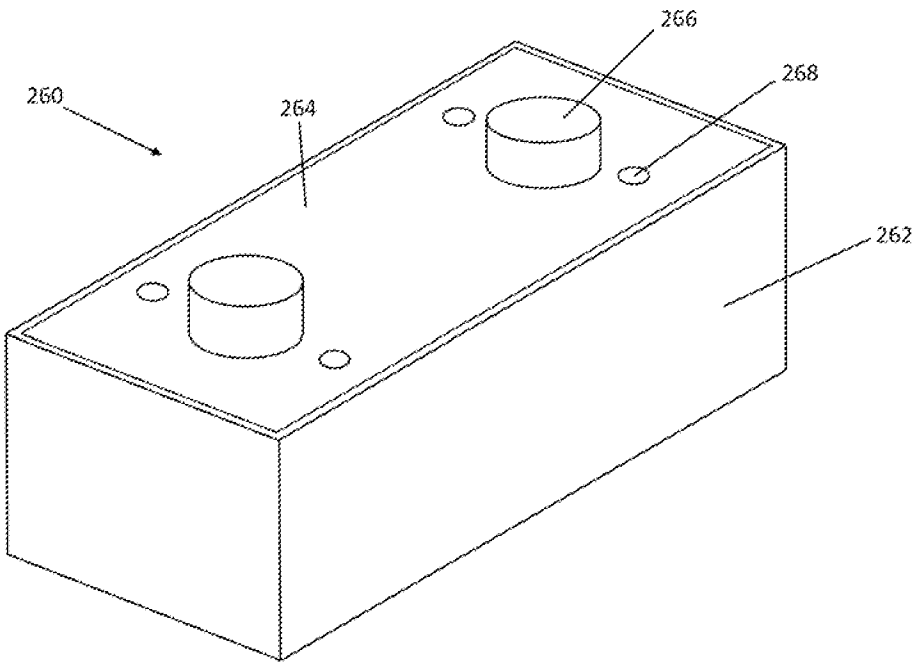
FIG. 15 is a perspective view of a building block, in accordance with alternative embodiments of the invention.
Figure 16:
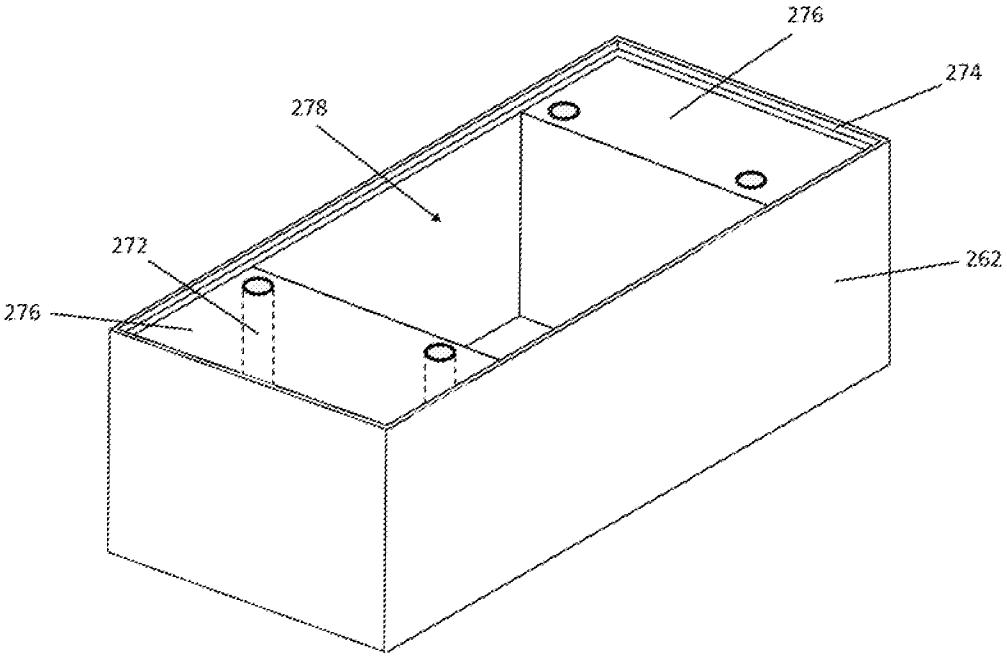
FIG. 16 is a perspective view of the building block of FIG. 15, with its lid removed.

The building block 20 has two upwardly projecting protrusions 26 (also termed projections) on the lid 24 (or any other suitable wall, but preferably on the top surface of the block) and two inwardly projecting depressions 38 (also termed indentations) in the bottom side (or any other suitable wall, but preferably on the bottom surface of the block) (seen in FIG. 5). The protrusions engage and form a locking connection with corresponding depressions in the bottom side of one or more adjacent blocks. When a plurality of building blocks is stacked in a typical running bond pattern (as seen in FIG. 14), the protrusions on one block typically engage with the depressions on two adjacent blocks, and the depressions on one block typically engage with the protrusions of two adjacent blocks. This engagement between the depressions and the protrusions on different blocks helps retain the blocks in their stacked positions. Any suitable adhesive may also be used between the stacked blocks (horizontally and vertically) to help retain the blocks in their stacked positions.

The building blocks of embodiments of the invention may have a vacuum fitting 30 to enable air to be drawn out of the chamber 23 once the fibers 12 are placed within the chamber 23 and the lid 24 is sealed in place. Any suitable, conventional vacuum fitting may be used. A user would attach a conventional vacuum pump (not illustrated) to the vacuum fitting 30 and operate the vacuum pump until a desired amount of air is removed (based on the pressure within the chamber, as determined by a pressure gauge on the vacuum pump). The preferred pressure in the chamber is about 5-50 millibar. At 50 millibars, about 95% of the air inside the chamber has been removed, while at 5 millibars about 99.5% of the air inside the chamber has been removed.

The building blocks of embodiments of the invention may have one have one or more through-holes 28 (four are shown in FIGS. 1-5) extending from the top wall (typically the lid) to the bottom wall of the building block. Each through-hole 28 is preferably defined by a cylinder 32 extending from the top wall to the opposing bottom wall. In addition to defining the through-holes, the cylinders add strength and rigidity to the building block. Each cylinder 32 is aligned with a corresponding hole in the top and bottom walls to form each through-hole. Each through-hole 28 is positioned to align with a corresponding through-hole in an adjacent building block when the blocks are stacked, and to receive a reinforcing rod 12 (e.g., rebar) through the aligned through-holes of the stacked blocks to help hold the blocks in their stacked positions.

FIGS. 6-9, illustrate a building block, in accordance with alternative embodiments of the invention. The building block 50 of FIGS. 6-9 is similar to the building block of FIGS. 1-5, in that the building block 50 comprises a housing 52 defining a chamber 53 into which plant fibers (not illustrated) may be placed. A lid 54 is selectively removable (before it is sealed into place) to enable the fibers to be placed in the chamber 53 and is selectively sealable to seal the fibers within the chamber 53. The housing 52 has a shoulder 64 around the top edge such that the lid 54 sits down into the opening and on the shoulder 64. The lid 54 also has a shoulder 66 to provide another sealing surface to which adhesive may be applied to ensure that the lid 54 is securely retained to the housing 52. The building block 50 has two upwardly projecting protrusions 56 on the lid 54 and two inwardly projecting depressions 76 in the bottom side. The building block 50 has a vacuum fitting 30 to enable air to be drawn out of the chamber 23. The building block 50 has four through-holes 58 extending from the lid to the bottom wall of the building block. Each through-hole 58 is defined by a cylinder 62 extending from the top wall to the opposing bottom wall.

Figure 7:
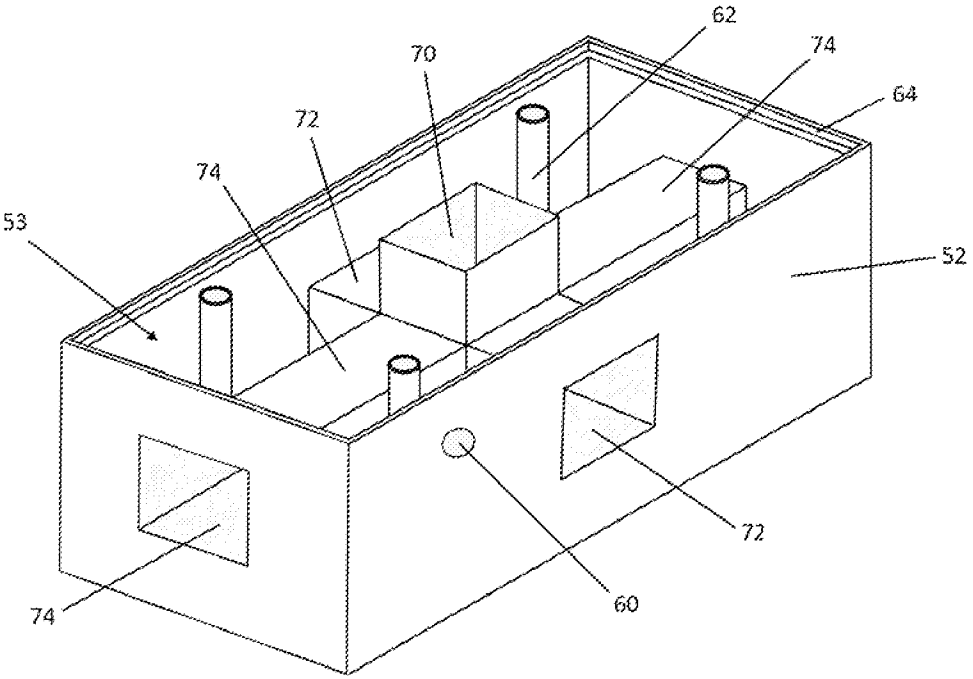
FIG. 7 is a perspective view of the building block of FIG. 6, with its lid removed.
Figure 8:
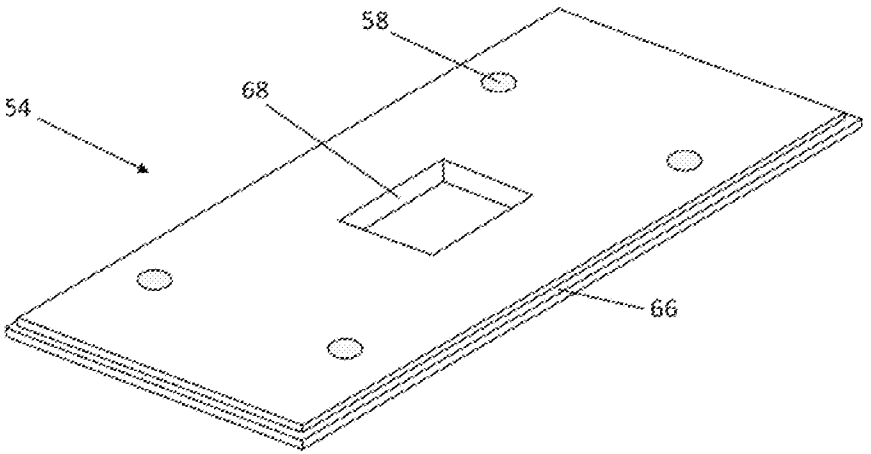
FIG. 8 is a perspective view of the underside of the lid of the building block of FIG. 6.
Figure 9:
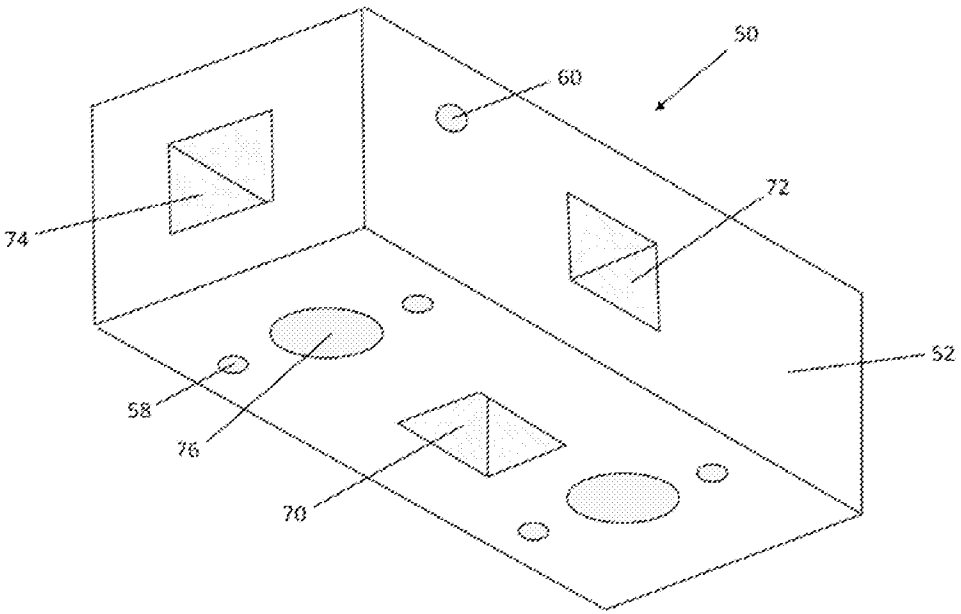
FIG. 9 is a perspective view from the bottom of the building block of FIG. 6.

Additionally, the building block 50 of FIGS. 6-9 has optional conduits that enable electrical lines and/or plumbing lines to be run through the blocks and therefore through the walls that are built using the blocks. A building block of embodiments of the invention may have none, one, two, or three of these conduits (and possibly, but preferably not, more than three). The building block 50 comprises a first conduit 70 extending from the lid 54 (aligned with hole 68 in the lid 54) to the bottom surface, a second conduit 72 extending perpendicular to the longitudinal axis of the building block 50, and a third conduit 74 extending parallel to the longitudinal axis of the building block 50. All three conduits may extend entirely through the building block from one side to the opposing side, as shown, or one or more conduits may only extend partly through the building block. For example, the second conduit that is extending perpendicular to the longitudinal axis of the building block might only extend from one side of the building block to the center of the block (where the second conduit would intersect with the first conduit and/or the third conduit). All three conduits are preferably centrally positioned in the building block for purposes of alignment with the conduits and/or end slots (described below) of one or more adjacent building blocks. As seen in FIG. 7, the first, second, and third conduits all intersect such that continuous pathways are defined among the first, second, and third conduits.

As described above, the building blocks of embodiments of the invention may have a horizontal slot or channel and/or a vertical slot or channel defined in one or both end faces. The end face channels are typically about half the width of the mid-block conduits, since the end face slots typically join with end face slots of an adjacent block, thereby together forming a conduit having about the same size as the mid-block conduits (as seen in FIG. 14).

Figure 10:
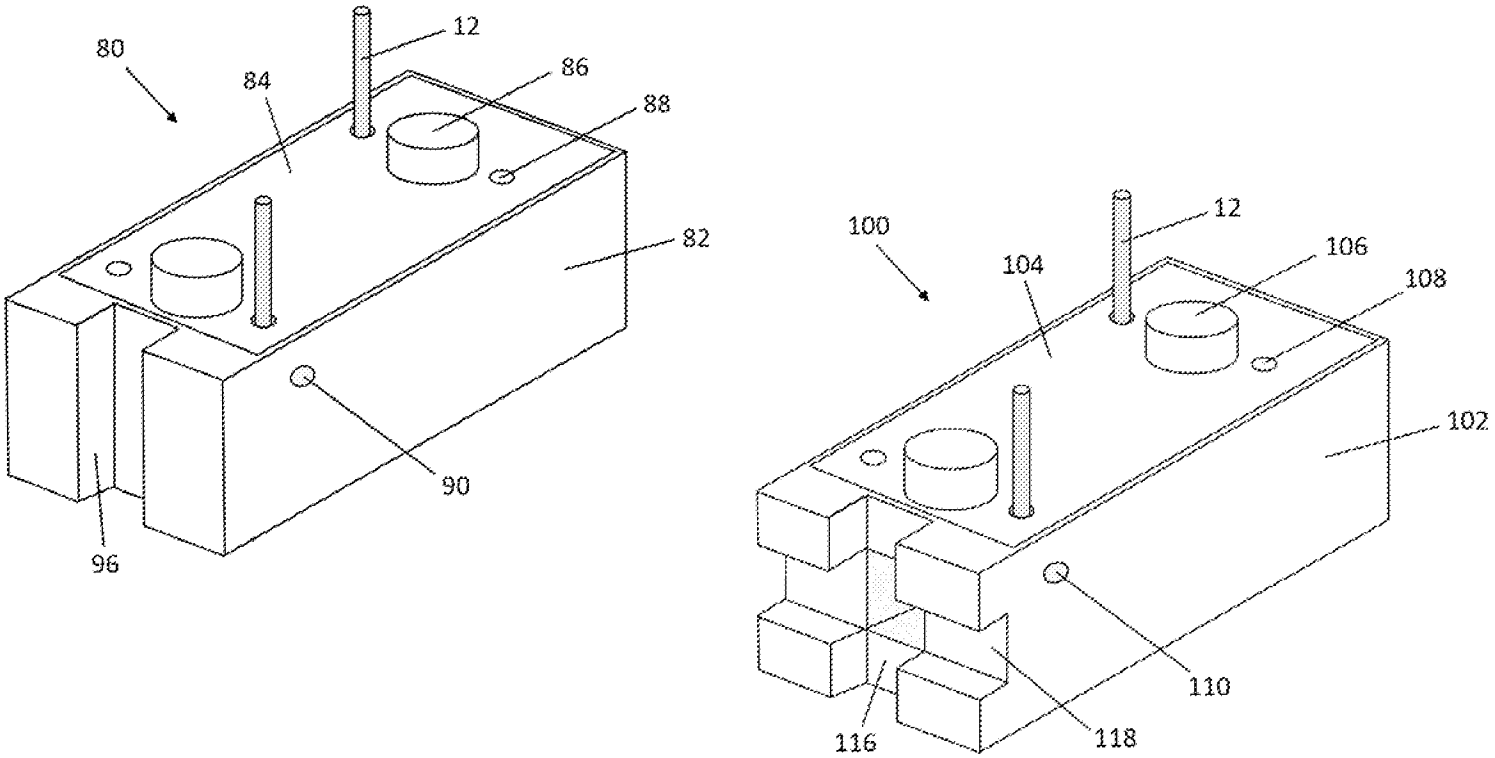
FIGS. 10-12 are perspective views of different versions of a building block, in accordance with alternative embodiments of the invention.
Figure 11:
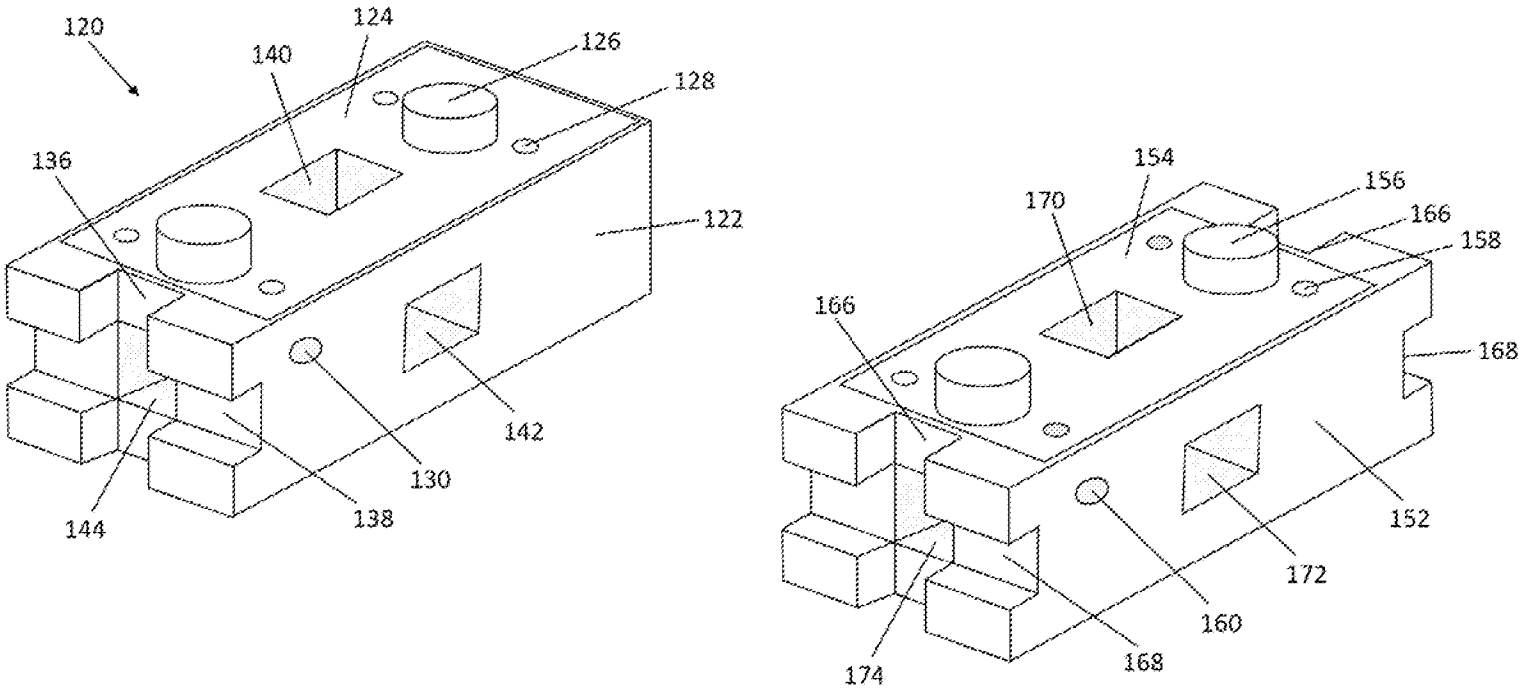

FIGS. 10 and 11 illustrate building blocks having end face slots, vertical and/or horizontal, on one or both end faces. In FIG. 10, the building block 80 comprises a housing 82, a lid 84 with two upwardly projecting protrusions 86 on the lid 84, a vacuum fitting 90, four through-holes 88 extending from the lid to the bottom wall of the building block through which a reinforcing rod 12 may be inserted, and a vertical end face slot 96 on one end face. In FIG. 10, the building block 100 comprises a housing 102, a lid 104 with two upwardly projecting protrusions 106 on the lid 104, a vacuum fitting 110, four through-holes 108 extending from the lid to the bottom wall of the building block through which a reinforcing rod 12 may be inserted, a vertical end face slot 116 on one end face, and a horizontal end face slot 118 on the same end face. In FIG. 11, the building block 120 comprises a housing 122, a lid 124 with two upwardly projecting protrusions 126 on the lid 124, a vacuum fitting 130, four through-holes 128 extending from the lid to the bottom wall of the building block, a first conduit 140, a second conduit 142, a third conduit 144, a vertical end face slot 136 on one end face, and a horizontal end face slot 138 on the same end face. In FIG. 11, the building block 150 comprises a housing 152, a lid 154 with two upwardly projecting protrusions 156 on the lid 154, a vacuum fitting 160, four through-holes 158 extending from the lid to the bottom wall of the building block, a first conduit 170, a second conduit 172, a third conduit 174, a vertical end face slot 166 on both end faces, and a horizontal end face slot 168 on both end faces.

Figure 12:
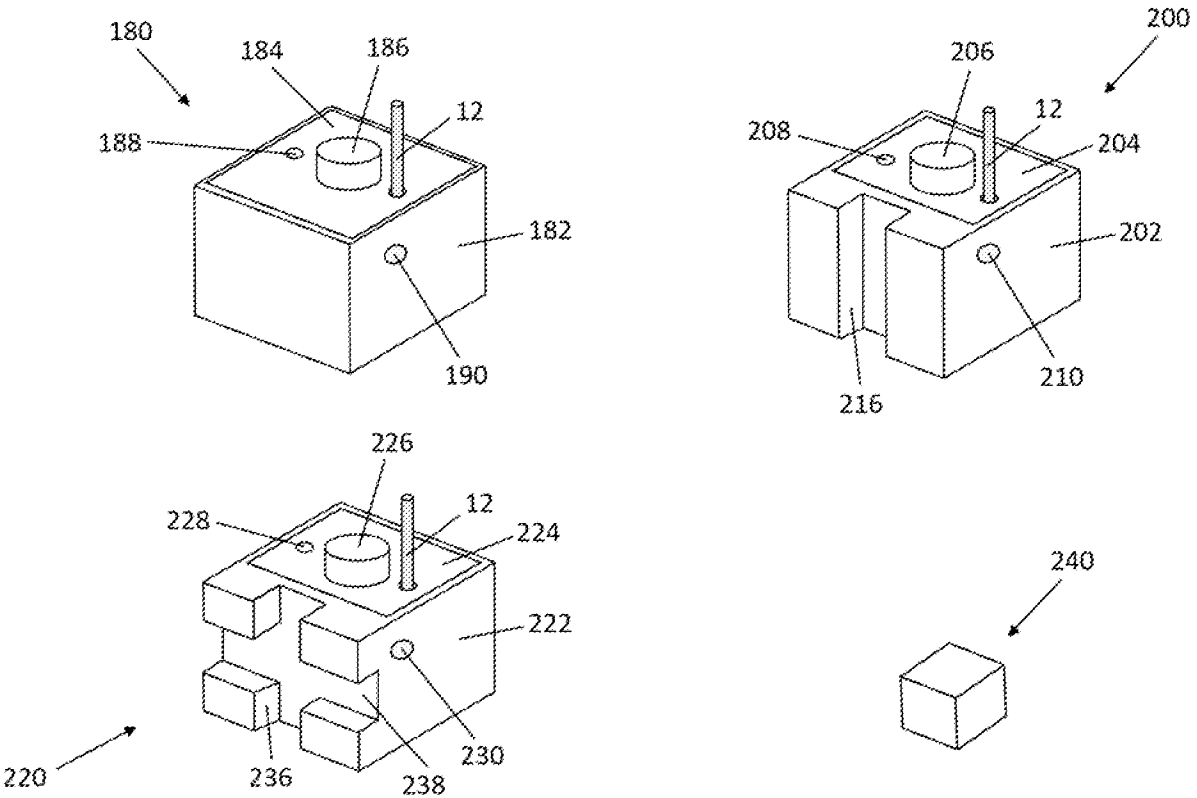

FIG. 12 illustrates three different half length block versions. Half length blocks are typically used at the beginning and/or end of some rows of building blocks stacked in a running bond pattern. Block 180 has a housing 182, a lid 184, one cylindrical protrusion 186 on the lid 184, two through-holes 188 through which a reinforcing rod 12 may be inserted, and a vacuum fitting 190. Block 200 has a housing 202, a lid 204, one cylindrical protrusion 206 on the lid 204, two through-holes 208 through which a reinforcing rod 12 may be inserted, a vacuum fitting 210, and a vertical end face slot 216 on one end face. Block 220 has a housing 222, a lid 224, one cylindrical protrusion 226 on the lid 224, two through-holes 228 through which a reinforcing rod 12 may be inserted, a vacuum fitting 230, a vertical end face slot 236 on one end face, and a horizontal end face slot 238 on the same end face.

FIG. 12 also illustrates a filler block 240, which in this representation has a generally rectangular prism shape (which may be a cuboid or a cube) and is sized to slide snugly into any of the conduits/channels formed within the blocks. Although not illustrated, the channels defined within the blocks would typically have one or more ridges or shoulders spaced apart from the channel opening to engage with the filler block when the filler block is inserted into the channel, positioned such that the outer surface of the filler block is flush with corresponding outer surface of the block.

Figure 13:
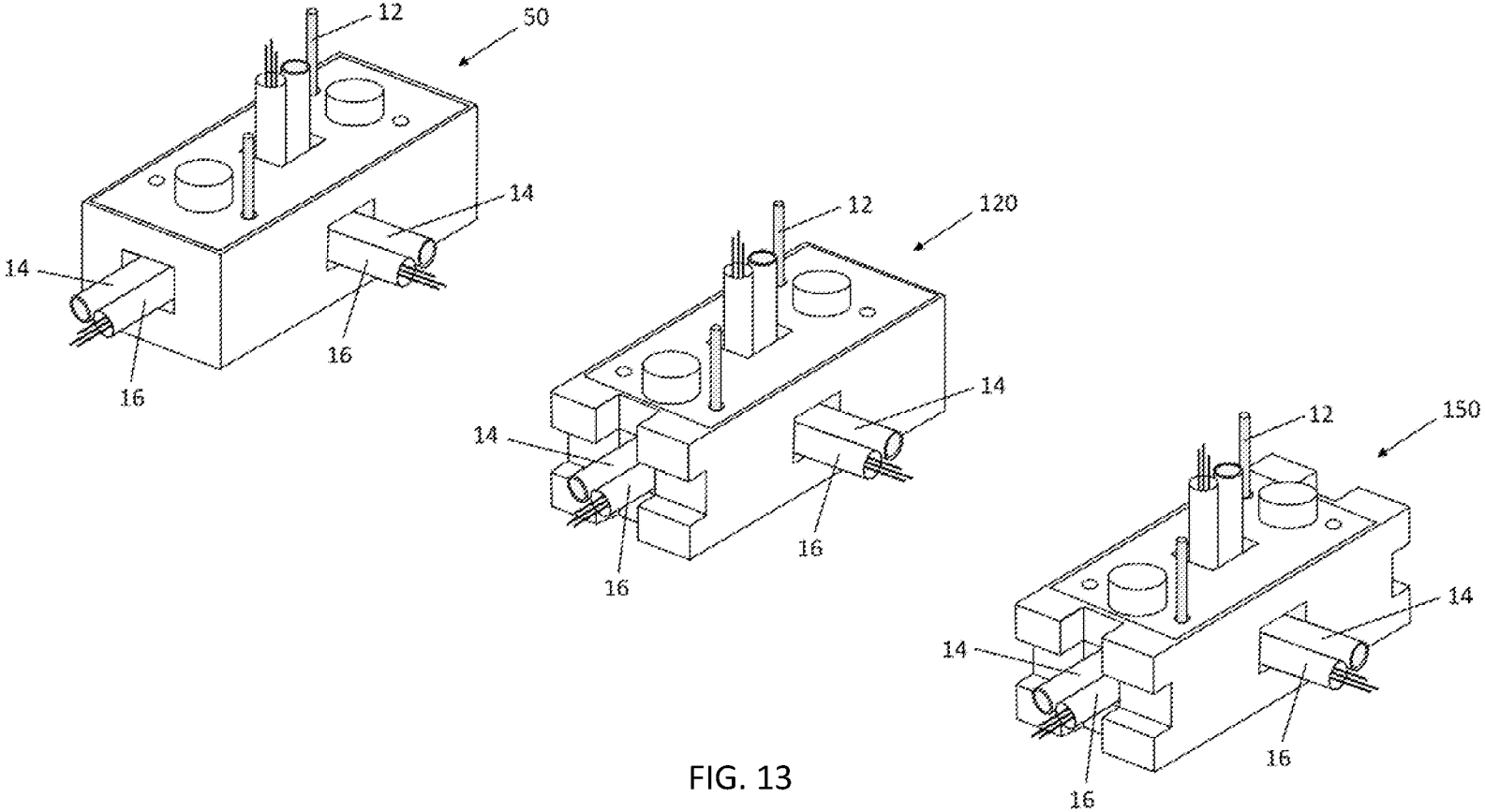
FIG. 13 shows perspective views of different versions of a building block, with electrical and plumbing lines in place, in accordance with alternative embodiments of the invention.

FIG. 13 shows perspective views of three different versions of a building block (block 50, block 120, and block 150), with plumbing lines 14 and electrical lines 16 running through the conduits. Some, all, or none of the conduits may contain one or more plumbing lines, one or more electrical lines, and/or one or more other utility lines (e.g., cable, networking, telephone, etc.) to distribute the utility line throughout the structure constructed using the building blocks.

FIG. 14 is a perspective view of portions of two walls, meeting at a corner, built using building blocks of embodiments of the invention. FIG. 14 shows the building blocks stacked in a running bond pattern, with staggered joints. Reinforcing rods 12 extend downward through the stacked blocks. Plumbing lines 14 and electrical lines 16 run through many of the conduits. Some conduits are blocked by filler blocks 240.

Figure 17:
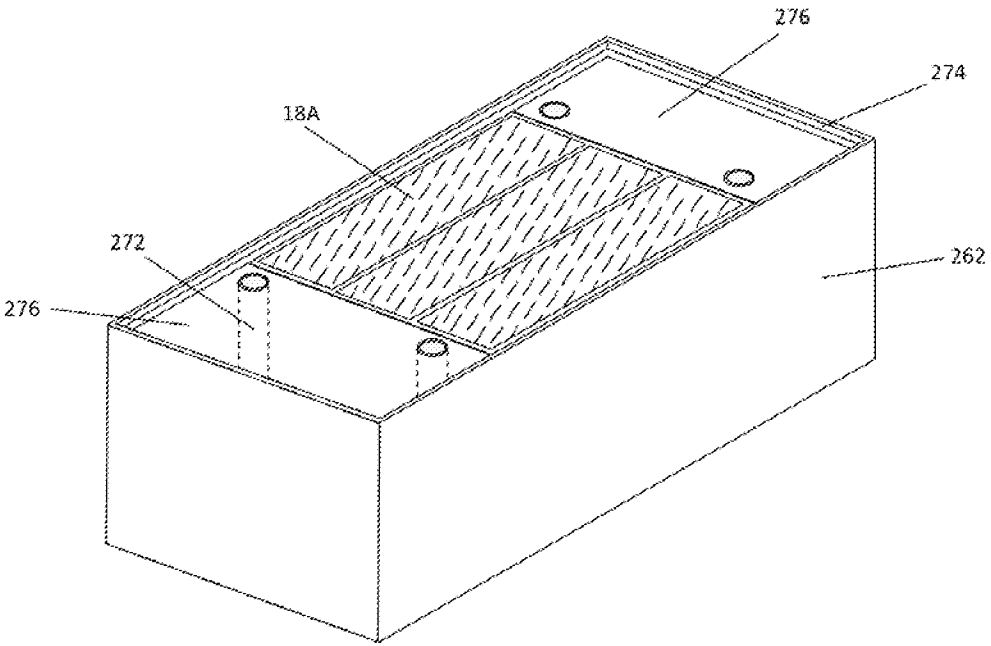
FIGS. 17-19 are perspective views of the building block of FIG. 15, with its lid removed and filled with plant fibers enclosed in different configurations of vacuum-sealed bags.
Figure 18:
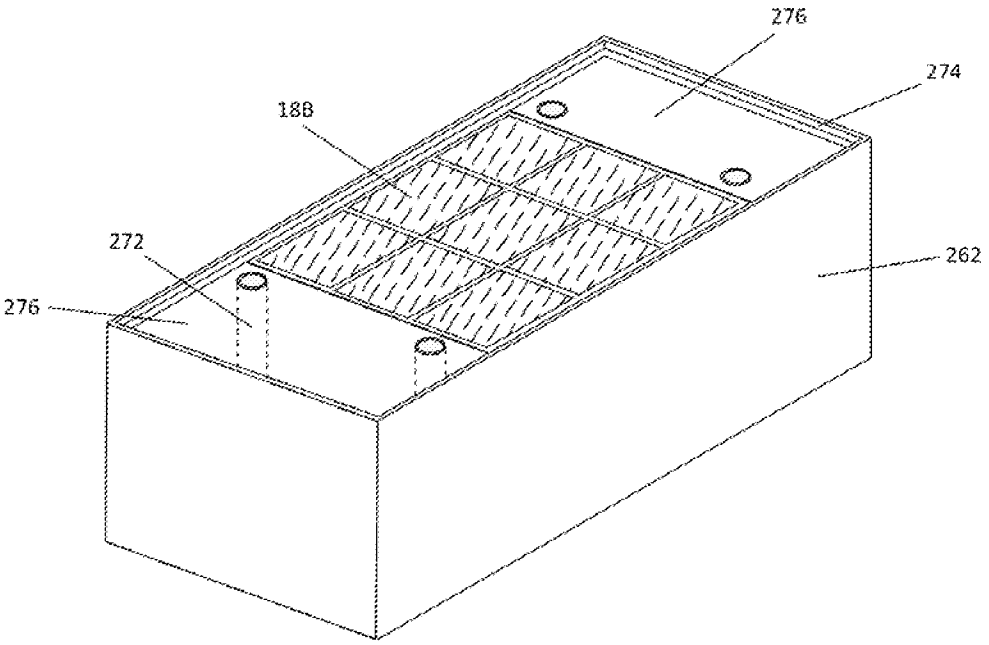
Figure 19:
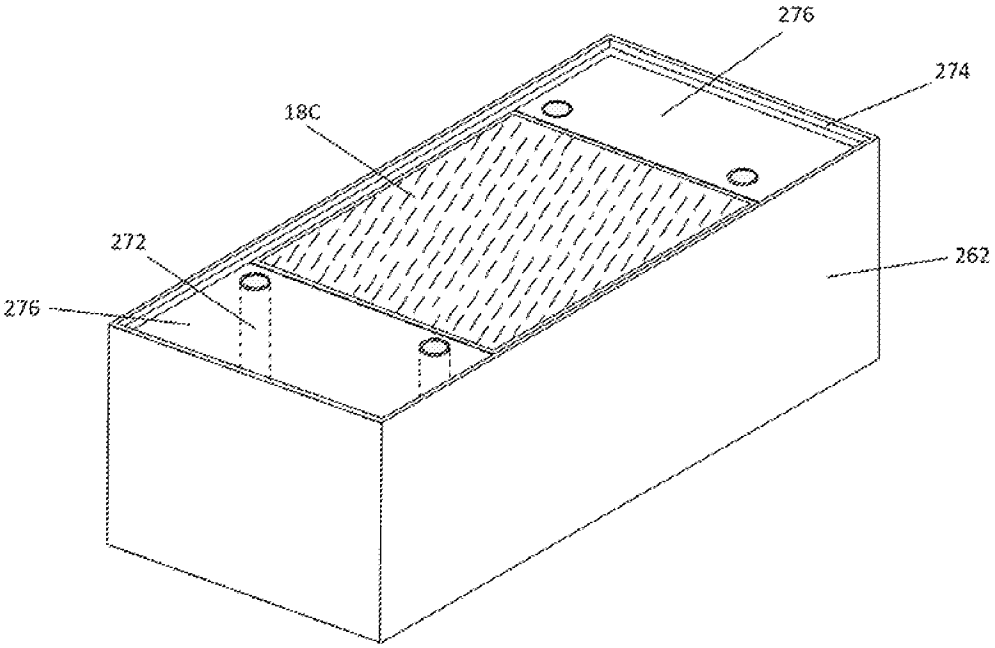

As described above, the plant fibers may be simply placed in the chamber of the building blocks, as shown in FIG. 3, or the plant fibers may be placed in one or more bags that are vacuum sealed, and then the vacuum-sealed bags are placed in the chamber. FIGS. 15-19 illustrate a building block designed to receive one or more vacuum-sealed bags of plant fibers. The building block 260 of FIGS. 15-19 comprises a housing 262 defining a chamber 278, a lid 264 with two upwardly projecting protrusions 266 on the lid 264, and four through-holes 268 extending from the lid to the bottom wall of the building block through which a reinforcing rod may be inserted. The housing 262 has a shoulder 274 around the top edge. The building blocks that accept the vacuum-sealed bags could have end face channels (not illustrated). The building blocks that accept the vacuum-sealed bags could have internal conduits (not illustrated). The through-holes 268 comprise cylinders defined in solid structures 276 located within opposing ends of the building block 260. These structures are preferably, but not necessarily, solid. These structures 276 reduce the size of the chamber 278, but also provide an unobstructed chamber into which the vacuum-sealed bag(s) may be placed. Any suitable number and size of vacuum-sealed bag(s) may be placed into the chamber. FIG. 17 illustrated three horizontally stacked vacuum-sealed bags 18A in the chamber. FIG. 18 illustrates nine vacuum-sealed bags 18B arranged in a grid pattern in the chamber. FIG. 19 illustrates one large vacuum-sealed bag 18C in the chamber. The fibers are vacuum-sealed in the bag(s) using conventional vacuum-sealing technology. The preferred pressure in the bags is about 5-50 millibar. At 50 millibars, about 95% of the air inside the bag has been removed, while at 5 millibars about 99.5% of the air inside the bag has been removed.

The building blocks are typically (but not necessarily) built off-site (including filling the containers with the plant fibers (loose or in vacuum-sealed bags), compressing the plant fibers (if desired), and sealing the lid in place), such as in climate-controlled manufacturing facilities, transported individually or in bulk to construction sites via various modes of transportation, and assembled on-site by placing the containers, per the architectural plan, alongside and on top of each other in standard running bond fashion, in a manner that may form exterior walls, interior walls, lintels (blocks of broader width (e.g., 48") will typically serve as lintels for doors and windows), and other uses. The bottom course of blocks is typically anchored to a cement slab or other floor foundation below, and the top course typically accommodate crossbeams or other ceiling structure above.

Electrical wiring, plumbing, and other essential systems may be run through the blocks' integrated channels. The stacked blocks may be clad with siding, veneer brick, plaster, or other finishing material on the structure's exterior, and may be clad with drywall, shiplap, wallboard, or other finishing material on the structure's interior.

The system of embodiments of the invention is designed to deliver some or all of the following positive attributes (versus conventional construction): thicker walls for improved security, sound-proofing, and weather-proofing; lower construction cost, due to the low cost of materials and the reduced labor and time needed for on-site construction; improved thermal insulation without need for separate purchase and use of conventional insulation materials; improved fire resistance due to the ignition and heat transference capabilities of compacted natural fibrous material; improved thermal mass to maintain internal temperatures and reduce heating/cooling costs; reduced risk of moisture or insect infiltration and damage due to the sealed state of the blocks; improved ecological responsibility due to the use of waste materials (when possible) in constructing, and agricultural byproducts or other waste material in filling, the containers; and improved carbon sequestration, reducing the emission of carbon dioxide and methane to the atmosphere.

The system of embodiments of the invention is designed to deliver some or all of the following positive attributes (versus conventional bale houses): improved transport, including over long distances, due to the fully contained nature of the blocks; reduced construction time and cost due to the simple method enabled by the containers; reduced risk of fire, pest infestation, and moisture penetration during the building phase; and improved design and cladding options (rather than just various types of plaster).

The system of embodiments of the invention also provides design flexibility, improved access to affordable housing, additional revenue to farmers (who often must burn or otherwise dispose of agricultural byproducts or other waste material such as straw), and job creation in rural communities (where manufacture of the containers is anticipated).

The system of embodiments of the invention does not include conventional bales, whether in raw or molded form, does not combine conventional bales with a discrete bracing or frame system, does not form or compress fibrous material into any type of block form, does not use mortar, cement or any other type of adhesive material on the fibrous material itself, and does not cut or compress fibrous material to form any type of block.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A building block comprising:

a rigid housing defining a chamber, the housing comprising at least a top wall and an opposing bottom wall; and plant fibers contained within the chamber, wherein the plant fibers are inserted into one or more bags and the one or more bags are vacuum-sealed, and wherein the one or more vacuum-sealed bags are inserted into the chamber of one or more of the plurality of building blocks;

wherein a through-hole extends from the top wall to the bottom wall, the through-hole adapted to align with a corresponding through-hole in an adjacent building block and to receive a reinforcing rod.

2. The building block of claim 1, wherein the plant fibers comprise one or more of cereal crop straw, hemp fiber, corn stover or straw, bamboo fiber, Johnson grass, or thatch grass.

3. The building block of claim 1, wherein the housing comprises six walls forming a generally rectangular prism shape.

4. The building block of claim 1, wherein the top wall comprises a lid that is selectively sealable to seal the plant fibers within the chamber.

5. The building block of claim 1, wherein the top wall has one or more projections adapted to interlock with one or more corresponding indentations on a bottom wall of one or more adjacent building blocks; and wherein the bottom wall has one or more indentations adapted to interlock with one or more corresponding projections on a top wall of one or more adjacent building blocks.

6. The building block of claim 1, wherein the bottom wall has one or more projections adapted to interlock with one or more corresponding indentations on a top wall of one or more adjacent building blocks; and wherein the top wall has one or more indentations adapted to interlock with one or more corresponding projections on a bottom wall of one or more adjacent building blocks.

7. The building block of claim 1, further comprising a vacuum fitting secured to the housing and adapted to enable air to be drawn out of the chamber.

8. The building block of claim 1, wherein the plant fibers are contained within one or more vacuum-sealed bags.

9. The building block of claim 1, wherein the through-hole is defined by a cylinder extending from the top wall to the opposing bottom wall.

10. The building block of claim 1, wherein the housing comprises at least a first side wall and an opposing second side wall; and wherein the building block further comprises a first conduit extending from the first side wall to the second side wall adapted to receive electrical and/or plumbing lines.

11. The building block of claim 10, wherein the housing comprises at least a third side wall and an opposing fourth side wall; and wherein the building block further comprises a second conduit extending from the third side wall to the fourth side wall adapted to receive electrical and/or plumbing lines.

12. The building block of claim 11, wherein the building block further comprises a third conduit extending from the top wall to the bottom wall adapted to receive electrical and/or plumbing lines.

13. The building block of claim 12, wherein the first, second, and third conduits intersect such that continuous pathways are defined among the first, second, and third conduits.

14. The building block of claim 1, wherein the housing comprises at least a first side wall; and wherein the building block further comprises a first slot defined on the first side wall and adapted to abut a corresponding first slot defined on a wall of an adjacent building block to together define a first conduit between the building block and the adjacent building block.

15. The building block of claim 14, further comprising a second slot defined on the first side wall, the second slot perpendicular to and intersecting the first slot, the second slot adapted to abut a corresponding second slot defined on a same wall of an adjacent building block as the first slot to together define a second conduit between the building block and the adjacent building block.

16. A construction system comprising:

a plurality of building blocks, each building block comprising:

a rigid housing defining a chamber, the housing comprising at least a top wall and an opposing bottom wall; and plant fibers contained within the chamber, wherein the plant fibers are inserted into one or more bags and the one or more bags are vacuum-sealed, and wherein the one or more vacuum-sealed bags are inserted into the chamber of one or more of the plurality of building blocks;

wherein the plurality of building blocks are selectively stackable to form a wall; and wherein a through-hole extends from the top wall to the bottom wall of each building block, the through-hole adapted to align with a corresponding through-hole in an adjacent building block and to receive a reinforcing rod.

17. The construction system of claim 16, wherein the plant fibers of each building block comprise one or more of cereal crop straw, hemp fiber, corn stover or straw, bamboo fiber, Johnson grass, or thatch grass.

18. The construction system of claim 16, wherein the housing of one or more of the plurality of building blocks comprises six walls forming a generally rectangular prism shape.

19. The construction system of claim 16, wherein the top wall of one or more of the plurality of building blocks further comprises a lid that is selectively sealable to seal the plant fibers within the chamber.

20. The construction system of claim 16, wherein the top wall of one or more of the plurality of building blocks has one or more projections adapted to interlock with one or more corresponding indentations on a bottom wall of one or more adjacent building blocks; and wherein the bottom wall of one or more of the plurality of building blocks has one or more indentations adapted to interlock with one or more corresponding projections on a top wall of one or more adjacent building blocks.

21. The construction system of claim 16, wherein the bottom wall of one or more of the plurality of building blocks has one or more projections adapted to interlock with one or more corresponding indentations on a top wall of one or more adjacent building blocks; and wherein the top wall of one or more of the plurality of building blocks has one or more indentations adapted to interlock with one or more corresponding projections on a bottom wall of one or more adjacent building blocks.

22. The construction system of claim 16, wherein one or more of the plurality of building blocks further comprises a vacuum fitting secured to the housing and adapted to enable air to be drawn out of the chamber.

23. The construction system of claim 16, wherein the plant fibers of one or more of the plurality of building blocks are contained within one or more vacuum-sealed bags.

24. The construction system of claim 16, wherein the through-hole of the one or more of the plurality of building blocks is defined by a cylinder extending from the top wall to the opposing bottom wall.

25. The construction system of claim 16, wherein the housing of one or more of the plurality of building blocks comprises at least a first side wall and an opposing second side wall; and wherein the one or more of the plurality of building blocks further comprise a first conduit extending from the first side wall to the second side wall adapted to receive electrical and/or plumbing lines.

26. The construction system of claim 25, wherein the housing of the one or more of the plurality of building blocks comprises at least a third side wall and an opposing fourth side wall; and wherein the one or more of the plurality of building blocks further comprise a second conduit extending from the third side wall to the fourth side wall adapted to receive electrical and/or plumbing lines.

27. The construction system of claim 26, wherein the one or more of the plurality of building blocks further comprise a third conduit extending from the top wall to the bottom wall adapted to receive electrical and/or plumbing lines.

28. The construction system of claim 27, wherein the first, second, and third conduits intersect such that continuous pathways are defined among the first, second, and third conduits.

29. The construction system of claim 16, wherein the housing of one or more of the plurality of building blocks comprises at least a first side wall;

wherein one or more of the plurality of building blocks further comprise a first slot defined on the first side wall and adapted to abut a corresponding first slot defined on a side wall of an adjacent building block to together define a first conduit between the building block and the adjacent building block.

30. The construction system of claim 29, wherein the one or more of the plurality of building blocks further comprise a second slot defined on the first side wall, the second slot perpendicular to and intersecting the first slot, the second slot adapted to abut a corresponding second slot defined on a same side wall of an adjacent building block as the first slot to together define a second conduit between the building block and the adjacent building block.

31. A method of construction comprising:

obtaining a plurality of building blocks, each building block comprising a rigid housing defining a chamber, the housing comprising at least a top wall and an opposing bottom wall, a through-hole extending from the top wall to the bottom wall to align with a corresponding through-hole in an adjacent building block;

inserting plant fibers into the chamber of each of the plurality of building blocks;

stacking the plurality of building blocks to form one or more walls; and inserting a reinforcing rod through the through-holes of at least two adjacent building blocks, wherein the method further comprises inserting plant fibers into one or more bags and vacuum-sealing the one ore more bags; and wherein inserting plant fibers into the chamber comprises inserting the one or more vacuum-sealed bags into the chamber of one or more of the plurality of building blocks.

32. The method of claim 31, wherein the plant fibers of each building block comprise one or more of cereal crop straw, hemp fiber, corn stover or straw, bamboo fiber, Johnson grass, or thatch grass.

33. The method of claim 31, wherein the housing of one or more of the plurality of building blocks comprises six walls forming a generally rectangular prism shape.

34. The method of claim 31, wherein the top wall of one or more of the plurality of building blocks further comprises a lid that is selectively sealable to seal the plant fibers within the chamber; and wherein the method further comprises sealing the lid after inserting the plant fibers into the chamber.

35. The method of claim 31, wherein the top wall has one or more projections adapted to interlock with one or more corresponding indentations on a bottom wall of one or more adjacent building blocks; and wherein the bottom wall has one or more indentations adapted to interlock with one or more corresponding projections on a top wall of one or more adjacent building blocks.

36. The method of claim 31, wherein the bottom wall of one or more of the plurality of building blocks has one or more projections adapted to interlock with one or more corresponding indentations on a top wall of one or more adjacent building blocks; and wherein the top wall of one or more of the plurality of building blocks has one or more indentations adapted to interlock with one or more corresponding projections on a bottom wall of one or more adjacent building blocks.

37. The method of claim 31, wherein one or more of the plurality of building blocks further comprises a vacuum fitting secured to the housing and adapted to enable air to be drawn out of the chamber; and wherein the method further comprises applying a vacuum device to the vacuum fitting to draw air out of the chamber.

38. The method of claim 31, wherein the through-hole of the one or more of the plurality of building blocks is defined by a cylinder extending from the top wall to the opposing bottom wall.

39. The method of claim 31, wherein the housing of one or more of the plurality of building blocks comprises at least a first side wall and an opposing second side wall; and wherein the one or more of the plurality of building blocks further comprise a first conduit extending from the first side wall to the second side wall to receive electrical and/or plumbing lines; and wherein the method further comprises inserting one or more electrical lines and/or one or more plumbing lines through the first conduit.

40. The method of claim 39, wherein the housing of one or more of the plurality of building blocks comprises at least a third side wall and an opposing fourth side wall; and wherein the one or more of the plurality of building blocks further comprise a second conduit extending from the third side wall to the fourth side wall to receive electrical and/or plumbing lines; and wherein the method further comprises inserting one or more electrical lines and/or one or more plumbing lines through the second conduit.

41. The method of claim 40, wherein the one or more of the plurality of building blocks further comprise a third conduit extending from the top wall to the bottom wall to receive electrical and/or plumbing lines; and wherein the method further comprises inserting one or more electrical lines and/or one or more plumbing lines through the third conduit.

42. The method of claim 41, wherein the first, second, and third conduits intersect such that continuous pathways are defined among the first, second, and third conduits.

43. The method of claim 31, wherein the housing of one or more of the plurality of building blocks comprises at least a first side wall;

wherein one or more of the plurality of building blocks further comprise a first slot defined on the first side wall and adapted to abut a corresponding first slot defined on a side wall of an adjacent building block to together define a first conduit between the building block and the adjacent building block.

44. The method of claim 43, wherein the one or more of the plurality of building blocks further comprise a second slot defined on the first side wall, the second slot perpendicular to and intersecting the first slot, the second slot adapted to abut a corresponding second slot defined on a same side wall of an adjacent building block as the first slot to together define a second conduit between the building block and the adjacent building block.

45. The building block of claim 1, wherein the housing comprises plastic or fiberglass.

46. The construction system of claim 16, wherein the housing of each building block comprises plastic or fiberglass.

47. The method of claim 31, wherein the housing of each building block comprises plastic or fiberglass.

* * * * *